US012151880B2

(12) United States Patent
Baur et al.

(10) Patent No.: US 12,151,880 B2
(45) Date of Patent: Nov. 26, 2024

(54) HYBRID SMART COMPOSITE CONTAINER AND METHOD OF OPERATING THE CONTAINER

(71) Applicant: Aeler Technologies SA, Lausanne (CH)

(72) Inventors: David Baur, Gorgier (CH); Naïk Londono, Chavannes-près-Renens (CH); Quentin Cabrol, Renens (CH)

(73) Assignee: Aeler Technologies SA, Lausanne (CH)

( * ) Notice: Subject to any disclaimer, the term of this patent is extended or adjusted under 35 U.S.C. 154(b) by 815 days.

(21) Appl. No.: 17/276,159

(22) PCT Filed: Sep. 18, 2019

(86) PCT No.: PCT/IB2019/057862

§ 371 (c)(1),
(2) Date: Mar. 15, 2021

(87) PCT Pub. No.: WO2020/058873

PCT Pub. Date: Mar. 26, 2020

(65) Prior Publication Data

US 2021/0300674 A1 Sep. 30, 2021

(30) Foreign Application Priority Data

Sep. 18, 2018 (WO) ..... PCT/IB2018/057139

(51) Int. Cl.
*B65D 90/02* (2019.01)
*B65D 90/51* (2019.01)

(52) U.S. Cl.
CPC ..... *B65D 90/022* (2013.01); *B65D 90/51* (2019.02); *B65D 2590/0083* (2013.01)

(58) Field of Classification Search
CPC ..... B65D 90/022; B65D 90/08
See application file for complete search history.

(56) References Cited

U.S. PATENT DOCUMENTS 4,271,975 A * 6/1981 Ketner ..... B65D 90/022 52/282.4
4,531,278 A * 7/1985 Boykin ..... B65D 90/022 29/469

(Continued)

FOREIGN PATENT DOCUMENTS

JP 10101190 4/1998
JP 2004262622 9/2004

(Continued)

OTHER PUBLICATIONS

International Search Report mailed on Dec. 13, 2019, for International Patent Application No. PCT/IB2019/057862.

(Continued)

*Primary Examiner* — Don M Anderson
(74) *Attorney, Agent, or Firm* — Nixon & Vanderhye P.C.

(57) ABSTRACT

A shipping container including a container frame arranged along edges of the shipping container having a rectangular shape, side wall panels made of a composite material, attachment elements attached between the container frame and tire side wall panels, a computer unit having a communication device, and a plurality of sensors measuring environmental parameters of the shipping container arranged at the side walls, the plurality of sensors operatively connected to the computer unit by the communication device.

20 Claims, 9 Drawing Sheets

(56) References Cited

U.S. PATENT DOCUMENTS

| | | | | |
|---|---|---|---|---|
| 6,109,052 | A * | 8/2000 | Austin, Jr. | B65D 90/027 62/297 |
| 2006/0081628 | A1* | 4/2006 | D. Myers | B65D 90/08 220/1.5 |
| 2008/0211669 | A1* | 9/2008 | Dagher | G08B 13/26 428/56 |
| 2009/0174989 | A1* | 7/2009 | Nagel | H04W 4/02 361/679.01 |
| 2009/0242552 | A1 | 10/2009 | Myers et al. | |
| 2010/0270318 | A1* | 10/2010 | Dagher | B65D 90/08 220/660 |
| 2012/0181270 | A1 | 7/2012 | Smith | |
| 2014/0225744 | A1 | 8/2014 | Claris | |
| 2015/0336732 | A1* | 11/2015 | Denson | B65D 88/02 220/592.25 |
| 2016/0039604 | A1* | 2/2016 | Baumert | B65D 90/14 220/560.01 |
| 2016/0239802 | A1* | 8/2016 | Burch, V | H04W 4/12 |

FOREIGN PATENT DOCUMENTS

| | | | |
|---|---|---|---|
| WO | WO 2007106584 | A2 | 9/2007 |
| WO | WO 2008045254 | A2 | 4/2008 |

OTHER PUBLICATIONS

Written Opinion of the ISA mailed on Dec. 13, 2019, for International Patent Application No. PCT/IB2019/057862.

Japanese Office Action: Notice of Reason for Rejection dated Apr. 19, 2022 for application JP 2021-514358 (EN translation).

Chinese Office Action issued on Feb. 24, 2022, for application No. CN 201980060995.1.

* cited by examiner

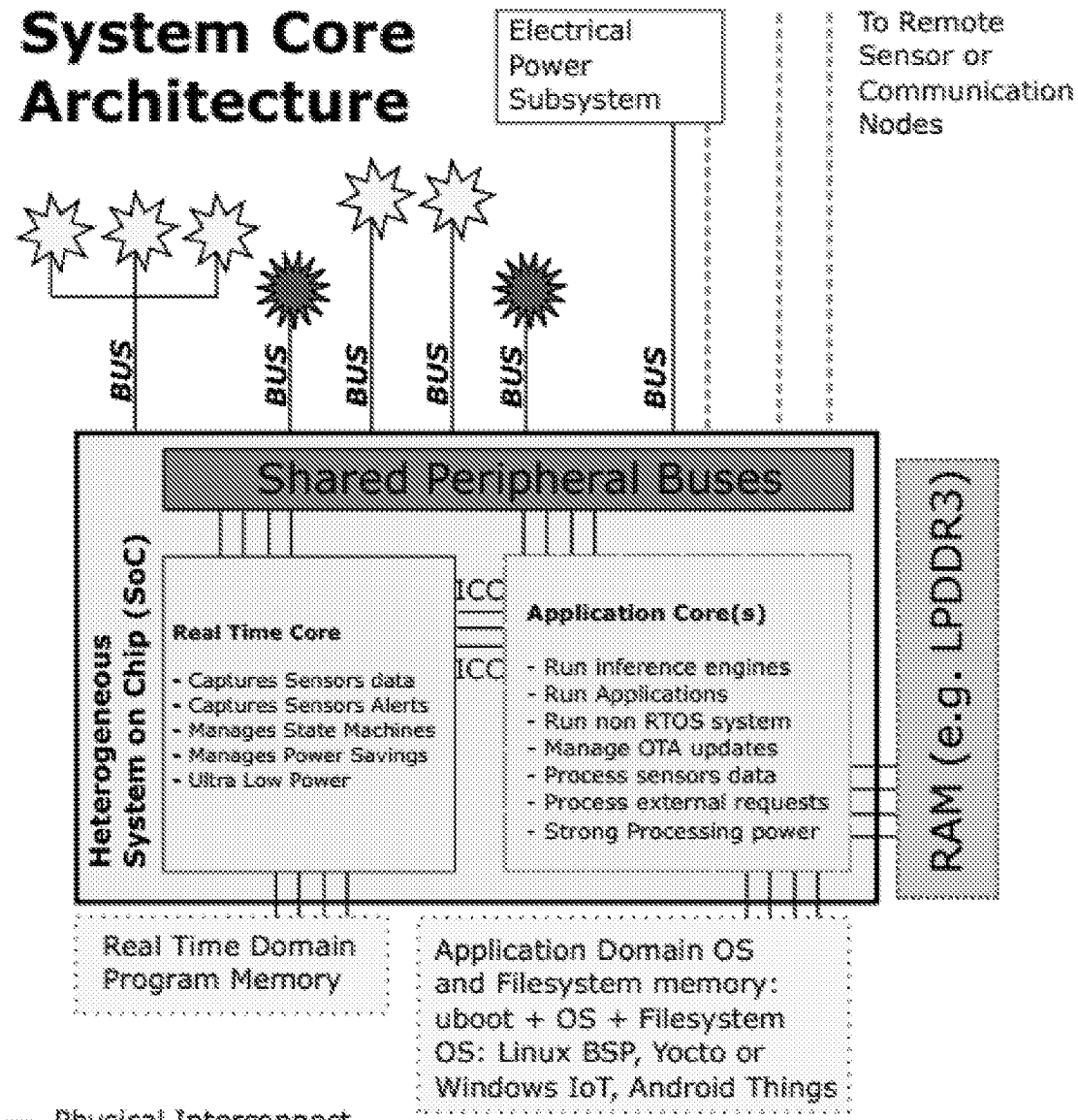

— Physical Interconnect

〰 Long distance bus (e.g. LINbus, CANbus, RS485, ...)

BUS Local communication bus (e.g. I2C, UART, USART, SPI, QSPI, 1-Wire, ...)

Telecommunication Module &/or end Node

Local Sensor (<5meters distance from SoC)

ICC Inter-Core Communication (e.g. RPMsg, OpenAMP)

Real Time Domain (Bare Metal or RTOS e.g. FreeRTOS)

Application Domain (Linux Yocto, Windows IoT, Android Things, ...)

Non Volatile Memory (QSPI/eMMC/Flash)

RAM (LPDDR3 or equivalent)

FIG. 4A

HYBRID SMART COMPOSITE CONTAINER AND METHOD OF OPERATING THE CONTAINER

CROSS-REFERENCE TO RELATED APPLICATIONS

The present patent application is an United States national stage patent application of International Patent Application No. PCT/IB2019/057862 that was filed on Sep. 18, 2019, designating the United States, and claims foreign priority to the International patent application with the Serial No. PCT/IB2018/057139 that was filed on Sep. 18, 2018, the entire contents of these two documents thereof herewith incorporated by reference.

FIELD OF THE INVENTION

The present invention pertains to the field of cargo containers, a method of manufacturing a cargo container, and methods of managing cargo containers in the shipping process, or smart management of cargo containers for regular and specialized goods.

BACKGROUND

In the field of the shipping and transportation of goods, for example via trucks, cargo trains, and ships, standard-sized shipping and cargo containers are used. However, these shipping containers are heavy, subject to rapid deterioration due to the environmental conditions of the transportation routes and are suboptimal for the transportation of certain specialized goods such as, but not limited to, sensitive perishable goods and flexitanks. Moreover, in terms of their management for logistics, management solutions rely on their serial numbers and the geographic locations of their carriers, i.e. the ships, trucks, or cargo trains.

More specifically, in the flexitank industry, where bladder-like bags are filled with non-hazardous liquids and put in standard steel containers, the load weight limit for safety reasons is of 24 metric tons, or even 18 metric tons as advised by Germanischer Lloyds in one of their reports. The reason is that forces applied by the liquids on the lateral panels during transport pose a risk of deformation or even rupture of the steel panel or the flexibag. Damaged steel containers can then not be loaded next to other containers, the container must be repaired and the cargo must often be offloaded and moved to another mode of transport.

Moreover, tracking and real-time analysis of cargo conditions is currently very complex and limited. Such activities, when possible, rely on third party sensors that must be placed within the container, with only limited capabilities for communication during transit. As such, in-transit containers remains to this date largely black boxes and conditions of the container and the cargo within can almost only be assessed during unloading operations, potentially several weeks after loading, by visual inspection or by manually loading sensors data to a computer.

Moreover, management of fleets of containers or individual containers is a process in which the containers themselves take no active part. This means that information about the containers is collected either manually or electronically by management entities, the data processed and decisions about actions to be taken regarding a specific container are communicated to the relevant stakeholders. This manner of organization implies that very little information is available outside the usual channels of communication a specific management entity has planned for, stifling flexibility and significantly increasing response times in regards to adverse events. Another deficiency of this process is that information is often lost, wrongly transmitted or redundantly transmitted, leading to information bottlenecks and to a reduction of the amount of relevant information transmitted. No information regarding the container, its management and its content are currently processed internally by the container before sending results and preliminary decisions to other stakeholders.

Therefore, in light of the above discussed deficiencies of the existing shipping containers and their management, substantially improved containers and management methods are desired.

SUMMARY

According to one aspect of the present invention, a shipping container is provided. Preferably, the shipping container includes a container frame arranged along edges of the shipping container, side wall panels made of a composite material, a computer unit, and a plurality of sensors measuring environmental parameters of the shipping container, the plurality of sensors operatively connected to the computer unit.

According to another aspect of the present invention, a method for manufacturing a composite cargo container is provided. Preferably, the method of manufacturing the composite cargo container includes the steps of providing a metal frame for a cargo container, forming a side wall by laminating a first layer of material to a center frame panel and forming an end ledge at a side of the center frame panel, reinforcing the end ledge and edges of the center frame panel by a second laminate material, attaching an attachment element to the beams of the metal frame, and attaching the side wall to the attachment elements of the metal frame by an adhesive.

According to another aspect of the present invention, a container management method performed on a smart hybrid container, the smart hybrid container including a container frame having a rectangular shape, side wall panels made of a composite material, attachment elements attached between the container frame and the side wall panels, and a computer unit having a communication device, and a plurality of sensors measuring environmental parameters of the shipping container arranged at the side walls, the plurality of sensors operatively connected to the computer unit by the communication device, the method preferable comprising the steps of accessing data of the plurality of sensors by the computer unit, recording a time and a value of the data at the computer unit, and analyzing the data for detecting an anomaly of the accessed data.

The above and other objects, features and advantages of the present invention and the manner of realizing them will become more apparent, and the invention itself will best be understood from a study of the following description with reference to the attached drawings showing some preferred embodiments of the invention.

BRIEF DESCRIPTION OF THE SEVERAL VIEWS OF THE DRAWINGS

The accompanying drawings, which are incorporated herein and constitute part of this specification, illustrate the presently preferred embodiments of the invention, and together with the general description given above and the detailed description given below, serve to explain features of the invention.

FIG. 4A shows the system core architecture of the central unit according to an aspect of the present invention;

Herein, identical reference numerals are used, where possible, to designate identical elements that are common to the figures. Also, the images are simplified for illustration purposes.

DETAILED DESCRIPTION OF THE SEVERAL EMBODIMENTS

Different applications and uses for the hybrid connected composite container can be envisioned. According to one aspect of the present invention, a goal is to provide for an efficient and modern use of a new type of container, as an alternative to the currently used steel containers, which is connected out-of-the-box and provides accurate measurements of conditions during transportation.

Another goal of the present invention is to provide a container which is capable of processing data from sensors and provide decision making support in regards to the management of the cargo within or the management of the container itself. The sensors and the data processing unit that are both integrated into the container and provide for a smart container set-up that may be used to offer decision making support. An example is the analysis of intrusion detection sensors by the data processing unit, which the smart container can use to determine the probability of theft or security breaches, by the use of the onboard or on-container intelligence, on a container-to-container basis. This information can proactively be transmitted or otherwise made available to customs upon arrival to a port or other governmental facility and used as an inspection priority criteria. The internal processing unit is configured to read available information from the numerous sensors to compute probability densities of a predefined case happening, such as illicitly tampering the cargo, trafficking, or simply an inspection procedure by port authorities. Generally, the internal processing unit of the container is capable of determining in which situation it is and proactively informing the right stakeholder. Another example is the use of thermal and humidity sensors to generate alerts in case the probability of goods deterioration exceeds a defined threshold, or other manually or mathematically defined trigger, and mitigation activities, such as changing the route or mode of transport to speed up arrival of the goods, are needed.

Figure 1:
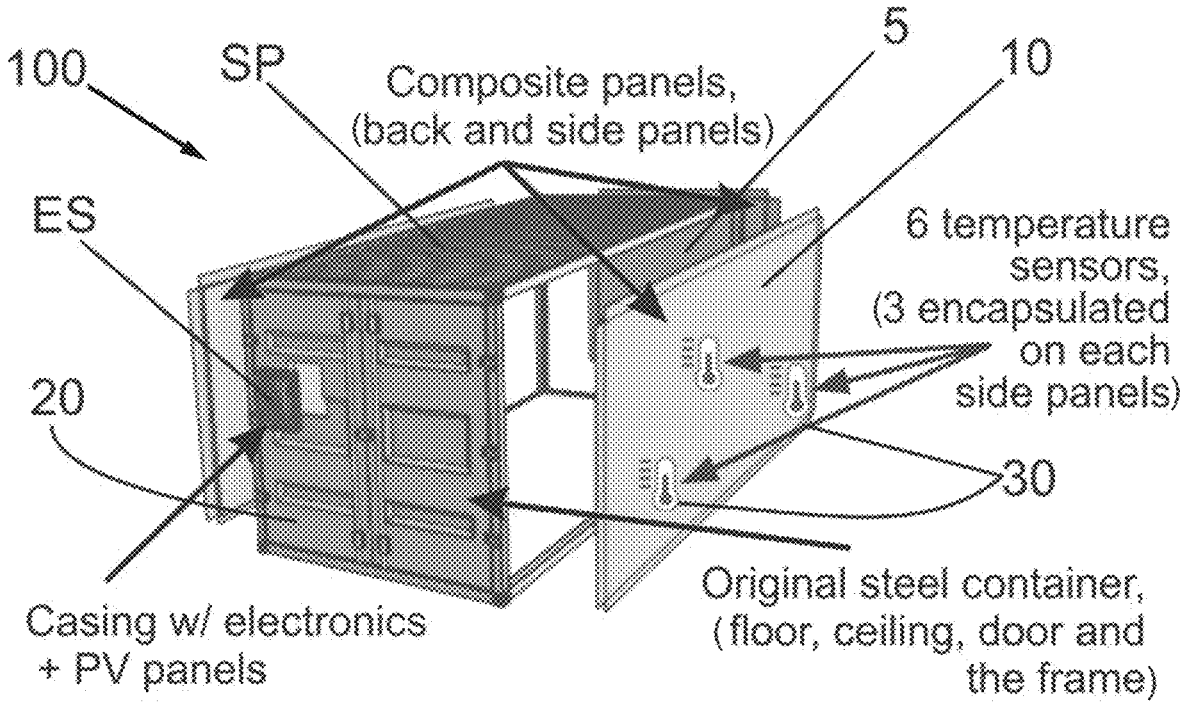
FIG. 1 shows a perspective exemplary exploded view of the hybrid container device according to one aspect of the present invention.

As shown in FIG. 1, the container device includes a container frame that can be made of a rigid material, for example steel or composite material, on which composite sandwich panels are fixed as sidewalls. The use of composite, i.e. materials composed of at least two different materials, panels drastically increases the overall container rigidity, bending or bulging-out resistance and physical characteristics. For example, there can be a tare weight reduction, improved aerodynamics, better thermal insulation, better radio frequency & X-Ray transparency, substantially corrosion and rust-free, higher rigidity, better behavior and resistance against fatigue. Preferably, the container device has a rectangular cuboid shape. More preferably, the container device has the standard ISO shipping container size, being 8 ft (2.43 m) wide, 8.5 ft (2.59 m) high and available in two lengths; 20 ft (6.06 m) and 40 ft (12.2 m). Extra tall shipping containers based on the standard ISO definition, also called high-cube containers, can have a height of 9.5 ft (2.89 m).

Furthermore, container 100 can include a highly powerful embedded computing system (ES) unit or data processing unit that is configured to monitor in near real-time both the container environment and the cargo condition inside. The ES can include a data processor, data memory of storage, network interfaces, and data interfaces to a variety of sensing devices. The ES can be included in a sealed casing that is encapsulated within the container structure itself, for example located inside door 40 forming the intelligent central unit whereas sensors 30 are dispatched to measure values inside the container, for example arranged within the lateral panels 10 to monitor activities of the entire container structure such as but not restricted to thermal sensors, in contrast with isolated measurement units available on the market. Finally, the ES is completely autonomous during the entire container lifetime, for example but not limited to a life cycle of ten (10) to fifteen (15) years, based on the use of photovoltaic panels SP that is operatively connected to the ES powering the unit and low-energy consumption. The photovoltaic panels SP can be placed on one or more sides of the container 100, and can be dimensioned to allow for autonomous operation of ES and the sensors 30, and also allow to charge the batteries that are associated with ES.

The ES can also be in operative connection with a heating or cooling unit HVAC that is configured to heat or cool the interior of the container 100. In this respect, the ES can record a time and a value of a temperature in real-time during all transportation operations for monitoring purposes, or similarly record a time and a value of a temperature when the temperature drops below a certain threshold value, and can control a heating unit HVAC to increase a temperature inside the container to a value above the threshold value, for example to prevent a freezing of the transported goods, for example goods that are transported in a flexitank 90. In case the container 100 is transported by a vehicle that has a cooling or heating system for several containers that is not part of container 100 itself, ES can provide for a signal to any external cooling or heating system to control the temperature.

Specific to the flexitank application, it is possible that a method of monitoring a freight container is performed, by measuring parameters with the sensor 30 that are included to the side wall panels 10, and thereafter by calculation a temperature or other value is calculated to determine the temperature value of the liquid inside the flexitank 90. This can be done by measuring several values of sensors 30, and thereafter using a pre-stored look-up table or artificial intelligence at the ES to determine an average value for the temperate of the liquid inside the flexitank.

According to one aspect of the present invention, the ES is configured to be autonomous for the entire container lifetime, by having on one hand, small power consumption, and on the other hand, sufficient battery capacity for providing energy, including photovoltaic panels arranged on an outer surface of container 100, preferably on the door, the roof or top element. A sensor mesh that is in operative connection with the ES can gather complete information about the container environment and the cargo condition. For example, the sensors 30 can include but is not limited to thermal or temperature sensors, gas sensors, pressure sensor, humidity sensor, position sensor for example a GPS sensor, acceleration sensor for example an inertial measurement unit (IMU), absolute orientation sensor, luminosity or light sensor, position detection sensors and switches (using for example capacitive sensors), for example to detect door openings, radioactivity detection sensor, volumetric sensor. These sensors are either encapsulated within the container structure itself or lie within the main casing, for example to measure environmental conditions inside and outside of the container volume. As explained above, preferably, at least some of the sensors 30 are arranged on the side wall panel 10.

Figure 5:
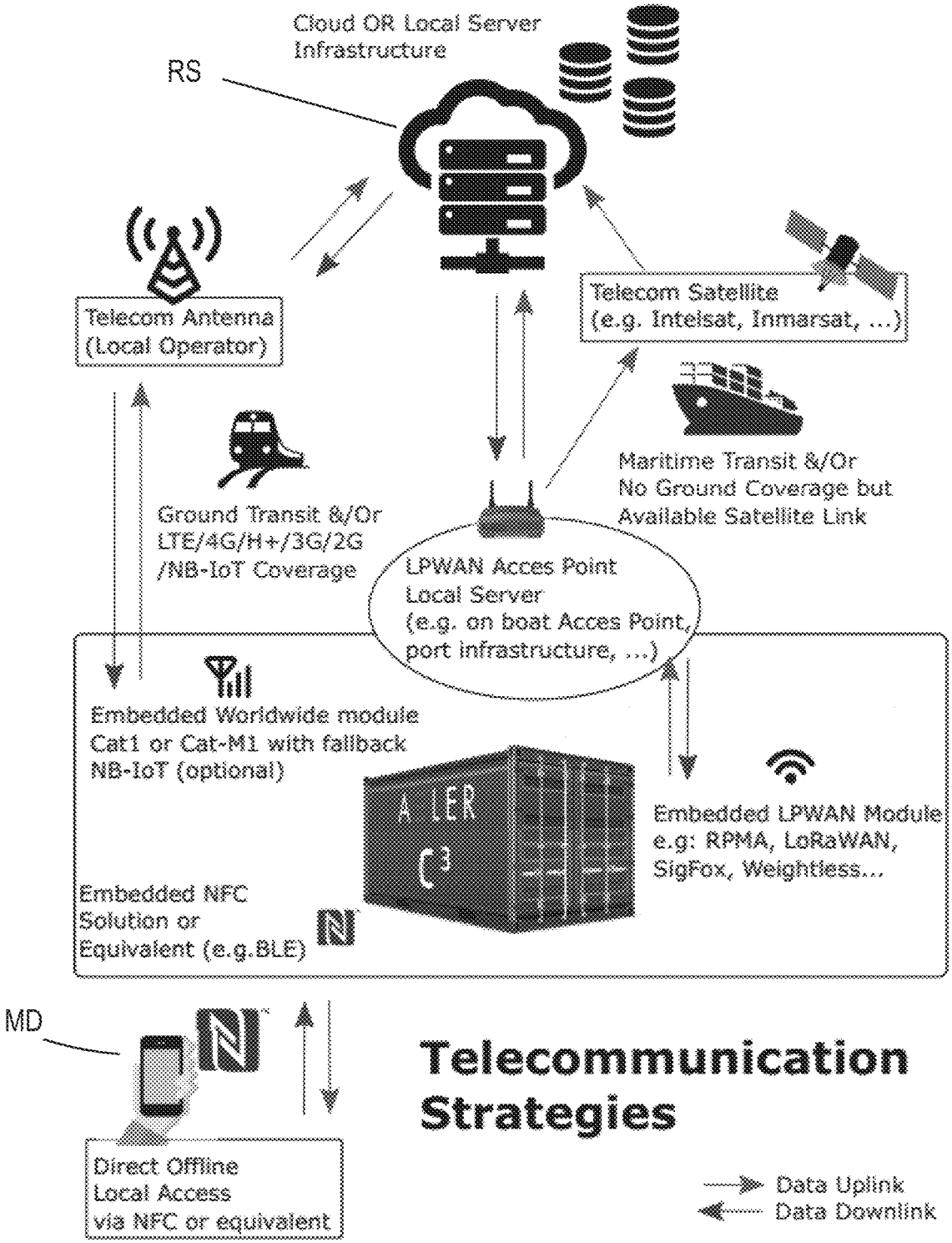
FIG. 5 corresponds to the diagram of communications between the container and the external environment.

To design the embedded system power efficiently, at least two core MCUs are used, one for the sensors' data aggregation, the other for everything related to the external communication and the embedded intelligence. The ES is thus able to run data analytics, machine learning or artificial intelligence onboard, making the container an intelligent node interacting with a more global intelligent fleet. Finally, from the communication standpoint, the ES is configured to communicate in near real-time and has backup storage in case the connection to a database is interrupted. The communication protocol match existing machine-to-machine (M2M) communication protocols to ensure versatility and adaptability to existing solutions. Numerous communication standards may be used (for contact, short and long range communication), such as but not restricted to RFID, LPWAN, GPRS. The communication will be two-sided (uplink and downlink), as the ES will be able to update itself with the help of firmware-update over-the-air robust with roll-back capability at system level and application level in order to deploy proprietary and/or third party firmware updates, OS updates and applications, and may also receive instructions from a remote data processing device, for example a computer that centrally manages a plurality of containers. The ES can include a satellite communication controller and antenna, or a transmitter and receiver for other types of long-range communication networks, for example an embedded worldwide module Cat1 or Cat-M1 with an optional fallback NB-IoT as illustrated in FIG. 5. For local wireless communication, for example for communication with local sensors 30 or the HVAC unit, embedded NFC can be used, for example Bluetooth low energy (BLE), as well as embedded LPWAN, LoRa WAN, SigFox, etc.

According to an aspect of the present invention, the container system and device are highly innovative compared to standard steel containers in several aspects. For example, it primarily uses composite materials as a structural element and is able to encapsulate electronics within these materials, to design a standardized intermodal container conventionally made out of steel. This can be cargo containers defined by the ISO 6346 or based on the ISO 668:2013 standard. The container has several separate elements that can be viewed as sub-components. Each sub-component can have variations in its building materials choices, design, manufacturing process and assembly process.

Figure 2:
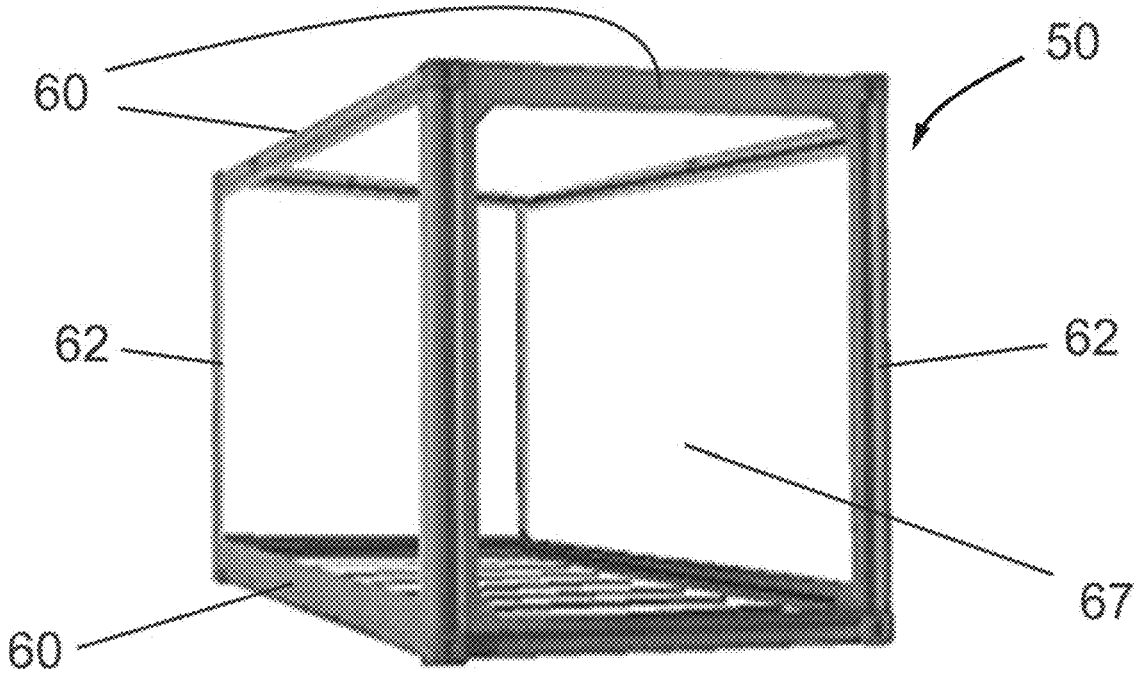
FIG. 2 shows a perspective exemplary view of the container support frame without the side walls, according to another aspect of the present invention.

One aspect of the present invention is the use of a rigid container frame 50, as shown in an exemplary embodiment in FIG. 2. The frame 50 or the skeleton of the container is the basic element giving the container its shape and overall rigidity to some extent. It is composed of horizontal rails 60 and corner posts 62, as shown in FIG. 2. Conventionally made out of steel, the herein presented container device uses frame material elements using composite materials, more specifically pultruded beams made out of glass fiber (GFRP), carbon fiber, or a combination thereof or any other FRP material. In a hybrid container design, the structural frame 50 can also be made out of steel to facilitate a fast manufacturing process. Nevertheless, the frame has, in this case, to be modified to optimize the assembly of the container panels (more on this in the manufacturing and assembly sections).

Figure 7A:
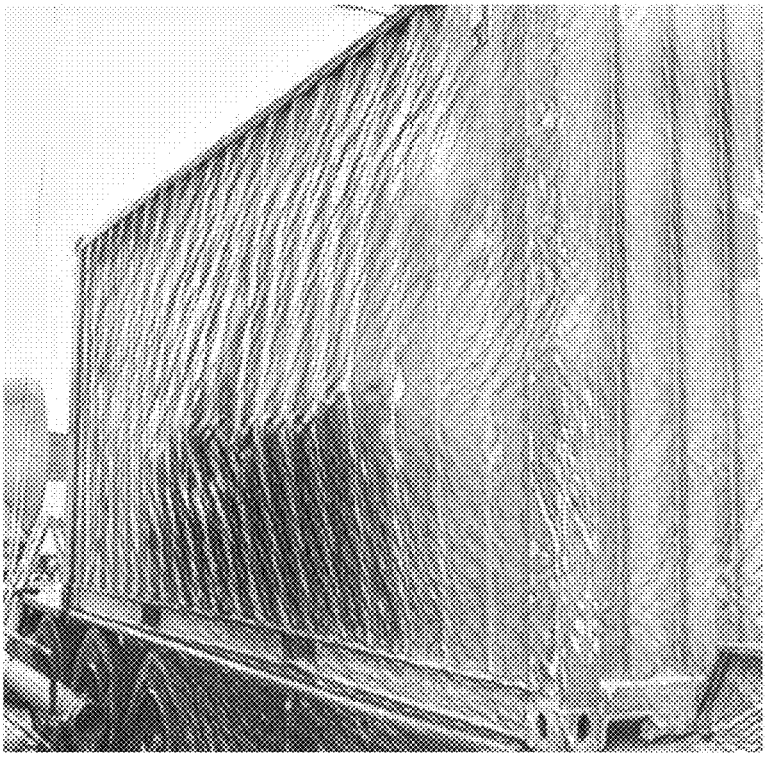
FIGS. 7A and 7B show the state of the art solutions where a flexitank has been placed into a conventional container having a structure and sidewalls that are not able to withstand a lateral pressure exerted onto the long side walls, causing the side walls of the container to bulge outwardly by a bulge, with FIG. 7A showing a conventional container loaded onto a truck having a bulged-out sidewall, and FIG. 7B showing a flexitank inside a container that is being filled, where the sidewall has been expanded outwardly due to the filling of a flexitank with a liquid, resulting in a high lateral pressure that could not be withstood by the side walls of the flexitank.
Figure 7B:
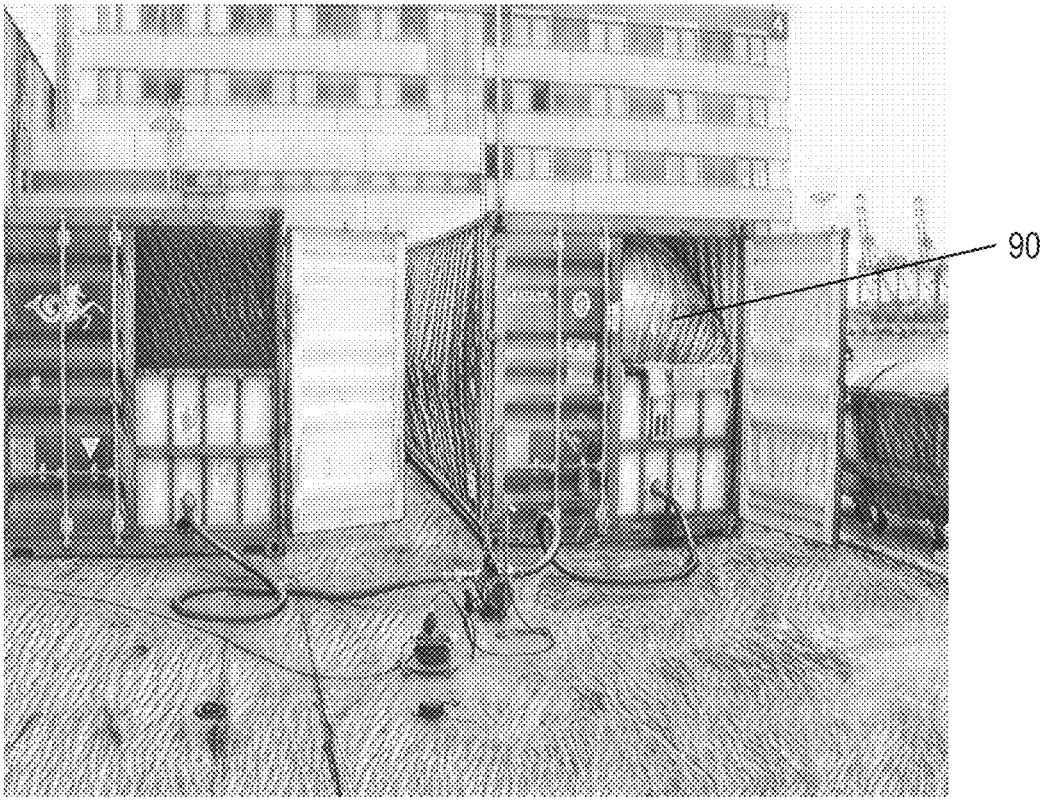

Another aspect of the present invention is the provision of panels as side walls, and the assembly thereof. As shown in FIG. 1, composite side wall panels 10 can be assembled or otherwise attached to the container frame 50. The composite side wall panels 10 are designed in such a way that the important distributive loads generated by the pressure of cargo, as for example a flexitank 90 (shown in FIG. 7B), pushing at the lateral side walls of the container 100 during the container in-transit are easily withstood. Also, a data processing unit ES, for example an industrial grade personal computer or embedded computing device, is integrated into the door 20 of container 100, for example placed inside of door panels, or attached inside an opening of door frame but visible to the outside of container 100. Side wall panels 10 include different sensors that can be embedded therein. Preferably, side wall panels 10 have a plurality of temperature sensors 32 that are distributed over the side wall panel 10, configured to measure an interior temperature at different locations inside container 100. For example, at least one of the temperature sensors 32 can be placed such that it can measure a location of contact of the flexitank 90 with the inner surface of side wall panel 10. Moreover, temperature sensors 32 are operatively connected to data processing unit ES, for example in a wireless or wired fashion.

With respect to the flexitank 90 that can be transported by container 100, filling and weight of such flexitank 90 has been a concern when using conventional metal freight containers. The flexitank 90 is basically a big synthetic bag that can be filling out a substantial part of an interior volume of container 100. With the conventional containers of the present, it is not possible to load more than 24 tons of liquid. The below discussed reinforced and sandwiched composite side wall panels 10, together with their attachment elements 63, 65 that are used for interconnection with a pre-existing frame 50 allow to fill up flexitank 90 with substantially more weight that is currently possible. In addition, the provision of additional insulation allows for reduced costs of cooling or heating, and the provision of sensors 30 and data processing unit ES allows to provide a smart monitoring of the content of container 100 on a localized level, for period monitoring based on threshold values, and for recoding the data for post-analysis, for example if direct communication with ES by satellite communication or by other telecommunication networks is not possible.

Moreover, the plurality of sensors 30 can also include bending or force measurement sensors 34 that are configured to measure a bending or force strain to the side wall panels 10, for example along a longitudinal and a traversal direction of each side panel 10, and these sensors 34 are operatively connected to data processing unit ES, for example in a wireless or wired fashion. This allows to make periodic measurements on the mechanical integrity of container 100, for example by monitoring a mechanical strain that is applied to side wall panels 10 on a periodic basis, and comparing the measured values at data processing unit ES with safety threshold values. The mechanical strain can be a result of the filling of container 100, but also due to the stacking of containers 100 in a unusual way, or overstacking. Another source of mechanical strain can be inclement weather during transport, for example due to wind that pushes on stacked containers 100, or heavy swell or waves causing rocking of the ship transporting containers 100.

Moreover, the plurality of sensors 30 of side wall panel can also include humidity sensors 36 or other types of sensors that can measure conditions of an atmosphere inside container 100. These sensors 36 are also operatively connected to data processing unit ES in a wired or wireless fashion. Similarly, sensors 36 in conjunction with data processing unit ES allow to track and record the environmental conditions inside the container 100, for example in a case where perishable goods are transported inside container 100, or goods that require to be in a given environmental conditions in terms of humidity and temperature, or measure any deterioration of the packaging of the goods inside the container, such as mold that can appear on barrels, which significantly reduces their market value, or even lead to returns in case of unsatisfied customers.

Other types of sensors that can be operatively connected to data processing unit ES include humidity sensors to measure the humidity inside of container 100, pressure sensors to measure the atmospheric air pressure inside container 100, light sensors to measure an intensity of light or illumination inside container 100, for example providing information to detect the status of the door of the container, e.g. whether it is open or closed, an acceleration sensor or inertial measurement unit (IMU), an absolute orientation sensor to determine if the container lies horizontally, or is stacked in a proper orientation with respect to a shipping vehicle such as a truck, container ship, freight train, air transport, door status sensors such as but not limited to position sensors, angular measurement sensors to measure the status of the door 40, or give feedback on how much the door 40 has been opened, GPS or other type of global positioning sensors for providing information on a location of the container 100, weight sensor or volumetric sensors that can provided for information on the weight or volume of goods that are currently inside container 100, fire detection sensors, gas sensors such as but not limited to oxygen sensor, ozone sensor, carbon monoxide and dioxide sensor, hydrogen sulfide sensor (h2s), methyl mercaptan sensor, dimethyl sulfide sensor, or other types of biochemical gas sensors, to provide for information on the gas content in the container, for example to determine a status of perishable goods or health risks to workers due to gas emissions when opening the container, and other types of sensor for organic compounds sensing.

Moreover, instead of using a pre-existing metal frame 50, it is possible to use a frame 50 that is made of a composite material and having the same or similar dimensions as metal frame 50 with horizontal bars 60 (four lower bars and four upper bars forming rectangles) and vertical posts 62 (four posts connecting the two rectangles). For example, composite frame could be made of rectangular carbon-fiber or fiberglass-reinforced tubes that are arranged together with corner fittings of the same or similar material.

Figure 3A:
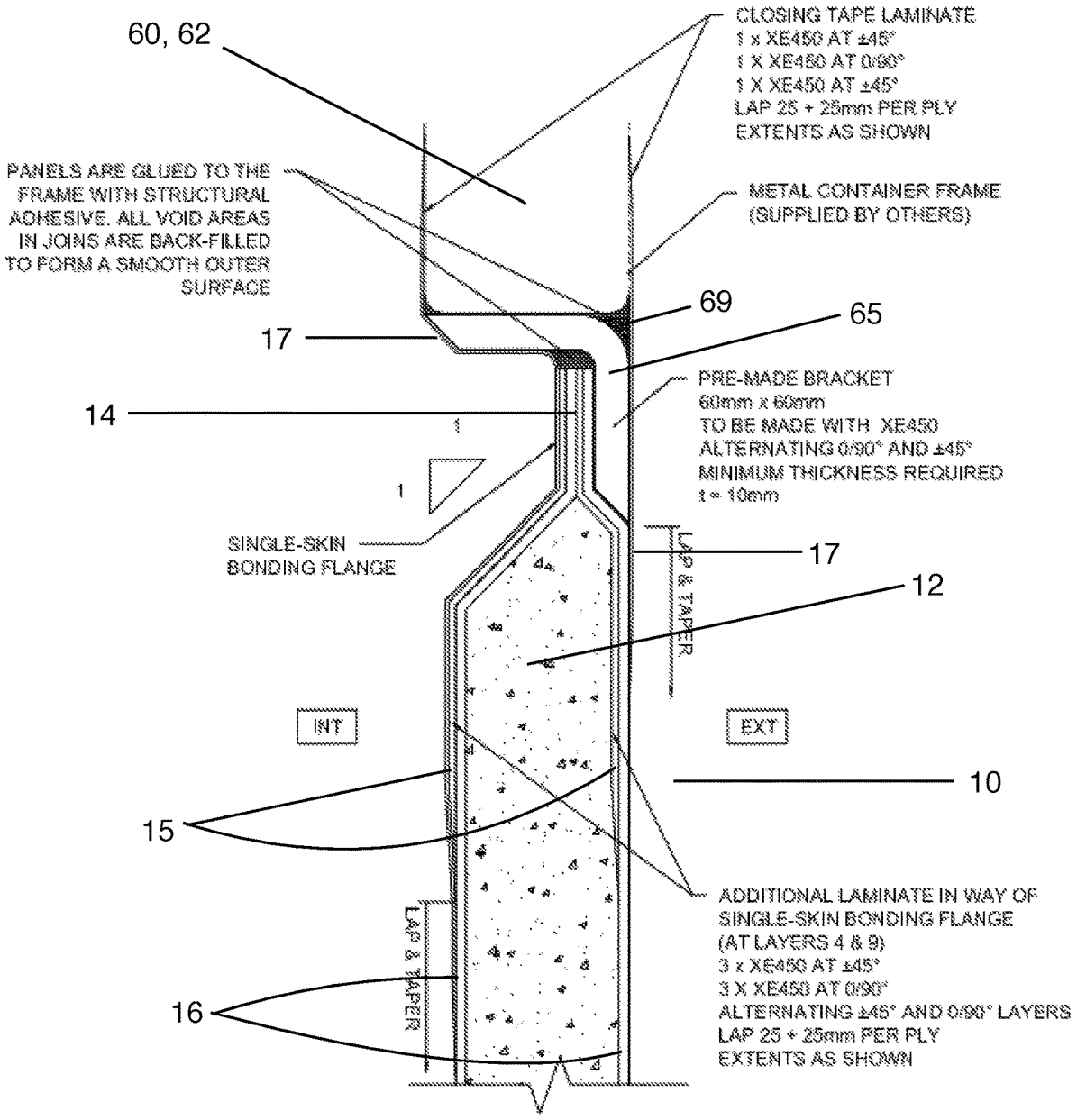
FIG. 3A shows a partial cross-sectional exemplary view of a side wall element and container frame, according to another aspect of the present invention.
Figure 3B:
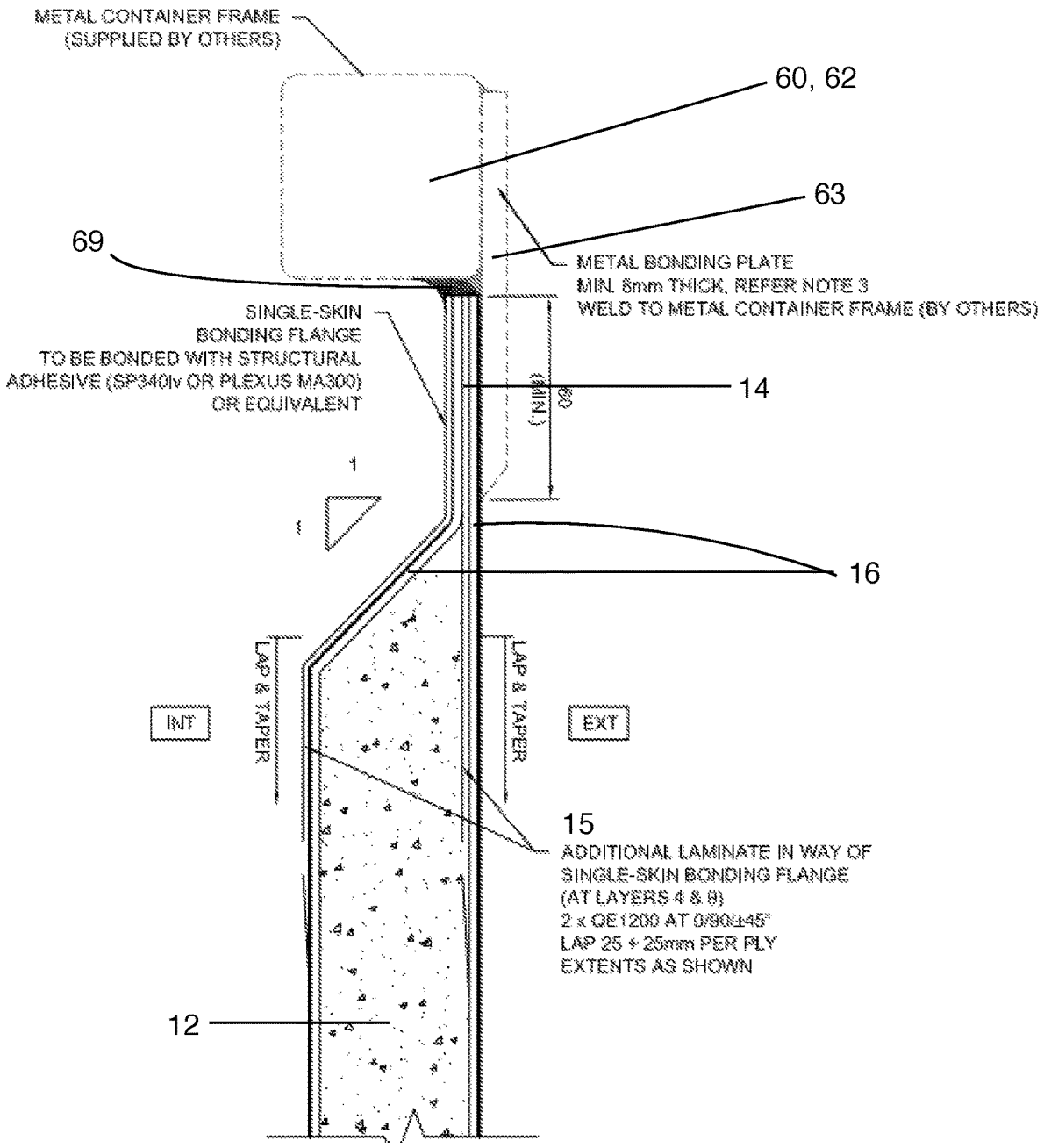
FIG. 3B shows another partial cross-sectional exemplary view of a side wall element and container frame, according to yet another aspect of the present invention.
Figure 4B:
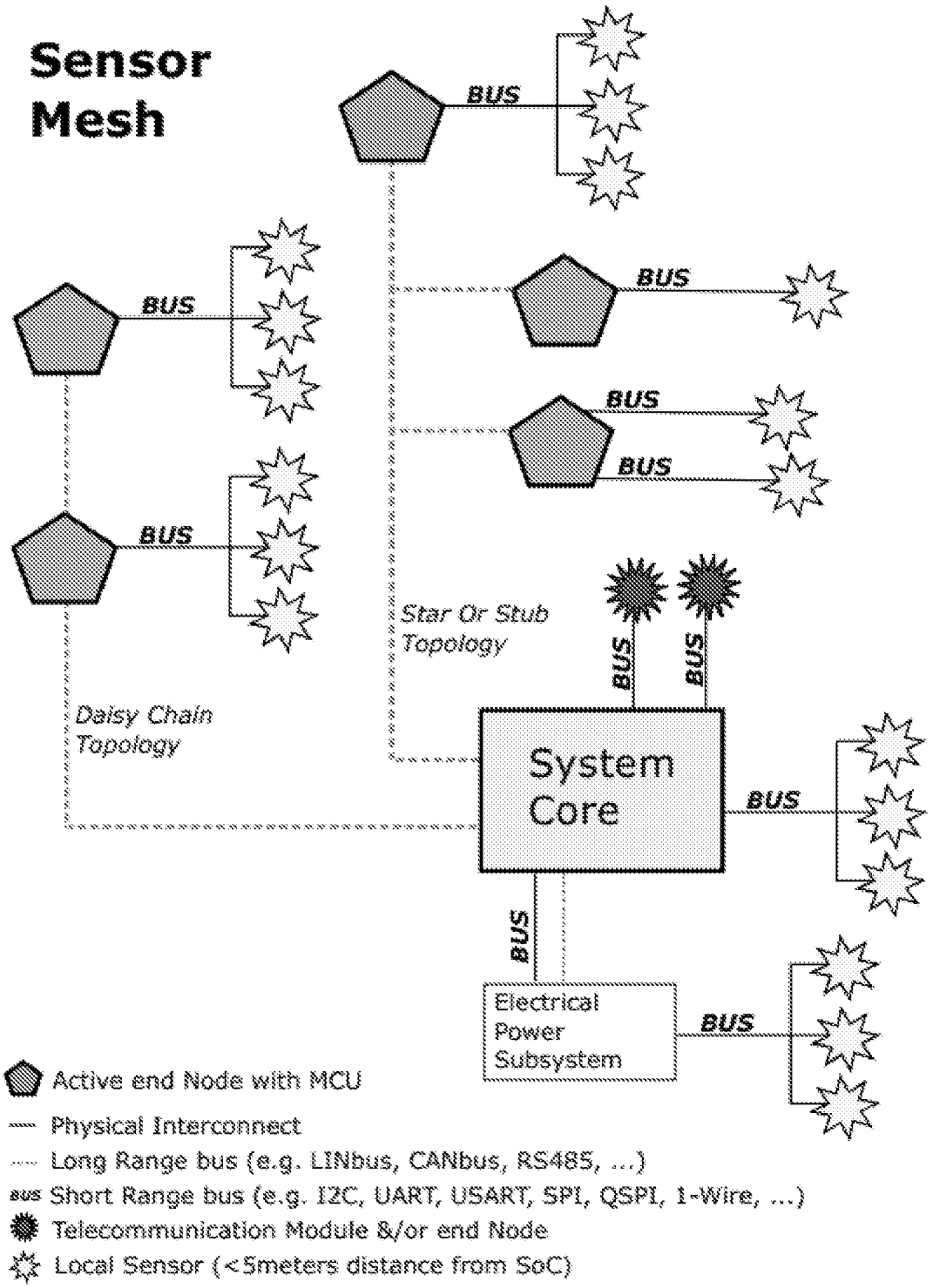
FIG. 4B shows the communication strategies between the central unit and the sensors mesh.

As shown in FIGS. 2, 3A, and 3B, the structural frame 50 and cross-sectional views of side wall panels 10 and frame 50 are shown. With the herein proposed construction of container 100, the loading capacity can be up to 30 metric tons, and they are easily withstood in case of the composite sandwich panels of side wall panels 10 as exemplarily shown in FIGS. 3A and 3B, in contrary to steel containers where this important loading would at least deform permanently or even break the walls, making the container impossible to use anymore. According to some aspects of the present invention, side wall panels 10 are therefore able to bend without fracture. This can be done by providing for a composite sandwich structure made of two externals hard-shell skins, for example but not limited to GFRP, Carbon, Kevlar, natural fiber, and a structural inner core, for example but not limited to balsa wood, PET, PVC, honeycomb, as further described below.

For example, side wall panels 10 are fitted into rectangular side openings 67 of the container frame 50, and side wall panels 10 are interconnected to frame 50 to the horizontal rails 60 and corner posts 62. This is shown exemplarily with the cross-sectional views of FIGS. 3A and 3B, these figures being shown to scale. In both these figures, a pre-existing container frame 50 is used without side panels and doors. For example, with the embodiment of FIG. 3A, at the upper end, a metal beam that forms horizontal rail 60 of pre-existing container frame 50 is shown in a cross-sectional view, having a substantially square shape. A L-shaped bracket 65 is attached thereto, with two sides having substantially the same length, for example 60 mm to 60 mm, to provide for a fixation surface to attach the side wall panels 10 to container frame 50. L-shaped bracket 65 can be attached to horizontal rail 60 or corner posts 62 by adhesion with a structural adhesive 69, and can be made by pultrusion process of FRP such as GFRP or CFRP, with a thickness depending of the type of the fiber and layout chosen. In another variant, the L-shaped bracket 65 is made of metal, and can be also welded or attached by other means to horizontal rails or beams 60 of frame 50. Moreover, the side wall panels 10 can be mode of center frame panel 12 that can be made of a core structural foam with thermal insulating capabilities and a structural basis, such as but not restricted to GFRP skin (quadriaxial fiberglass+epoxy/vinyl ester resin) and PVC/PET/Balsa core providing for both mechanical structure and thermal insulation, which is sandwiched between two outer layers of laminate material 16. At the edges of side wall panels 10, the wall is tapered or narrow out, so that the layers of laminate material 16 are bonded together to provide for a stiff end ledge 14 that protrudes away from the surface of extension of the side wall panels 10, forming a bonding flange to attach to L-shaped bracket 65. L-shaped bracket 65 can be formed as a rectangular frame to cover two horizontal rails 60 and two corner posts 62 that surround one side wall panel 10.

Moreover, edges of side wall panels 10 and the end ledge 14 further include a second mechanical reinforcement layer 15 at both sides of panels 10 and ledge 14, as an additional laminate. Reinforcement layer can be made of GFRP (quadriaxial/biaxial and vinyl ester/epoxy resin). In the assembled position, L-shaped bracket 65 and side wall 10 are shaped such that the outer surface of container 100 is substantially flat. Outer surface of both the pre-existing horizontal rail 60 or corner post 62 as well as the side wall panel are then covered with a third outer protective layer 17, that covers the interface between horizontal rail 60 or corner post 62 and side wall 10, for example to entirely cover the L-shaped bracket 65 on both inside INT and outside EXT. This provides for additional sealing, mechanical strength, and insulation. In addition, third outer protective layer 17 can provided for a smooth outer surface of the entire container 100 that allows to reduce wind and air resistance by up to 7% when transported by a truck or lorry on road transport. In addition, the non-metallic side panels 10 and back wall 5 are transparent to X-ray that facilitates automatized inspection.

End ledge 14 of the side wall panels 10 are made to be narrower in thickness than a main body of side wall panels 10 with the center frame panel 12. This allows to create a container 100 based on a pre-existing container frame 50 in which the inner volume and dimensions is not reduced, and still provides for the standard interior dimensions. At the same time, the container 100 has improve thermal insulation as compared to pre-existing containers by center frame panel 12, and is lighter in weight and mechanically more solid.

FIG. 3B shows a variant where the end ledge 14 that forms the bonding flange is arranged flush with the outer side wall of panel 10 and rail 60 or post 62, and is then attached to an inner surface of bonding plate 63. Bonding plate 63 can be formed as a rectangular frame to cover two horizontal rails 60 and two corner posts 62 that surround one side wall panel 10. Bonding plate 63 can be welded to pre-existing horizontal rail 60 or corner post 62, or can be made as an integral part to a custom-made frame 50, or be attached thereto by screws, rivets, or adhesive material. An area between end ledge 14 and rail 60 or post 62 can be filled with an adhesive 69 for bonding and insulation. The adhesive 69 and the layers 15, 16, 17 are made such that they can withstand harsh marine conditions, for example by using a marine-grade fiber reinforced plastic (FRP) material for layers 15, 16, 17. Side wall panels 10 therefore are sandwiched panels that are made of a core 12, with three layers of reinforcement layers 15, 16, 17.

As discussed above, the hybrid container 100 includes the container frame 50 made of a pre-existing metallic rectangular box shape, and the assembly can be completed by either using side wall panels 10 that include composite panels and the monolithic L-beam or L-shaped bracket 65 that forms an attachment element for interconnecting pre-existing frame 50 and panel 10, see for example in FIG. 3A, or by using metallic tabs or bonding plates 63 that are attached to an outer surface of rail 60 or post 62 that forms another type of attachment element for interconnecting pre-existing frame 50 and panel 10 seen for example in FIG. 3B. These designs allow to provide for a container design that is based on some existing features, thereby reducing costs and preserving dimensional standards, that is strong enough to comply with the ISO 1496-1:2013 test certifications for freight containers, for example the 22GP type containers. The composite side wall panels 10 and their integration into container frame 50 are configured to support at least 28 tons of distributed force, which is 16% more than currently possible with the pre-existing metal design. Moreover, the back panel 5, forming the side wall at the end of the container 100 that is opposite of the doors 20, can support 24 tons of distributed force. This new design also adds a substantial increased of thermal insulation to the container 100, allowing for reduced energy heating or cooling of the container 100.

Another aspect of the present invention is the design and arrangement of 20 of the container 100, and the encapsulation of the inner volume space of the container 100. The door 40 of container 100 can be used as the vessel of the ES that is in operative connection with the container 100, in other words, the ES can be integrated into the door of the container. To ensure barely any loads are applied on the casing of the ES, the door frame is designed in such a way it supports the majority of the constraint applied to the container structure 50. The door can be either made of steel, aluminum or composite material. The ES casing is then mounted onto panels of door 40 of container 100. To increase the impact-resistance of the casing and thus better protect the ES, the fixation strategies take into account dampening strategies, for example but not limited to the use of silent bloc, springs, shock absorbers in different axes of orientation. In this respect, computing unit 40 can be placed inside a cavity of door 40, and can be suspended in the cavity by springs. Nevertheless, even though the door is the best location, at least some parts of the embedded systems can also be placed elsewhere.

With respect to the corner fittings of each corner of the container frame, at each corner of the container, corner fittings can be placed that are configured to be grappled by equipment such as cranes to move the container and to maintain the container in place. These corner fittings can also be made out of materials such as but not limited to steel, glass fiber, carbon fiber, Kevlar™, and so on, but to account for the higher impact incidence and the necessity to replace them often, the present container innovation maintains corner fittings made out of steel in its design.

According to an aspect of the invention, a method for operating a smart container having a data processing unit ES and a plurality of sensors 30 is provided, for example the container 100 as described above. An exemplary representation of the method can be found in FIG. 8. The method can include a first step S05 where the operation is started. This can be done by receiving an external signal at the data processing device ES, for example from a remote server RS or a mobile device MD (see for example FIG. 5) that is in operative connection with data processing device ES, for example via a telecommunication network, by a manual operation at data processing device ES, autonomically by detecting a closing and locking of the door 20 of container 100, when a door lock status sensor provides or makes available a signal that indicates safe closure of container 100, for example by using another sensor like the light sensor that detects darkness inside container 100 or the switch sensor at the door. It is also possible that the measurements are started with step SOS before the container is closed, for example as soon as the loading of the container 100 is detected by a IMU sensor or by strain or force sensors that detect the loading of container or by manual log-in by the loading stakeholder through the short range communication (NFC for example). For this purpose, certain sensors 30 that will provide such information on the loading of the container 100 can be accessed and the data measured by data processing unit ES, to determine that door 20 is open, or open to a certain degree, and container 100 is being loaded, by using force sensors.

Next, once the operation has been started by a step S05, the method includes a step S10 of taking periodic, regular, or sporadic measurements from the available sensors 30 to measure different parameters of the container 100, by the data processing unit ES that reads or otherwise gathers data from the available sensors 30, and a step S20 of storing data of the period measurements inside a storage device that is in operative connection, located inside or an integral part of the data processing unit ES. In this step, it is possible that all of data of the available sensors 30 are read and stored, for example in a data log or file, and the data is time-stamped for each entry, for example with the use of a real-time clock. Next, the available data can be processed at the data processing unit ES for calibration in a step S30 for example to calculate values within the SI system for relative comparison, and a step S40 can be performed for analyzing and calculating additional data on the status of the cargo inside container 100, for example to detect any type of anomaly to the measured and accessed data from sensors 30. For example, data processing can be done that is specific to a status and condition of perishable goods that are transported. For example, this step can include the calculation of a sliding average or median value to see if the conditions are stable or whether they are changing. Preferably, the step of taking the measurements S10, storing S20, and calibrating S30 and analyzing S40 can be done during a low power condition of the data processing unit ES, to increase the operational time of the data processing unit ES. Also, with step S40, an additional step is performed where the measured data is compared to an upper or lower threshold value or threshold range, to determine whether one or more of the measured values lies outside of a safe or acceptable range or value.

With this step S40, the data processing unit ES determines on a regular or sporadic basis, depending on both the users requirements and the onboard intelligence, whether one or more of the measured data lies above or below an acceptable threshold, or whether one or more of the measured data lies outside a safe or acceptable range. For example, linear and angular accelerations to container 100 are measured and monitored, and when one of these accelerations lie outside an acceptable range or surpass an acceptable value, a data flag or alert is generated and associated to this measurement, for example as metadata. As another example, if the temperature inside the container 100 falls below a certain value, or surpasses a certain value, such data flag or alert is generated and associated to the data. As another example, a status and capacity of the energy in the battery pack that is associated to the data processing unit ES can be measured, and the energy that is currently being supplied by the solar panels SP, the ES can then manage itself in consequence, the data processing, sampling frequency, communication strategy. As another example, the absolute orientation of container 100 can be measured, to determine if the container 100 has been improperly moved, is placed at a wrong angle, has been tilted.

Another step S50 can be performed in parallel is the triggering or the setting of a measurement interval for the data processing unit ES and the sensors 30. For example, if the conditions are determined to be stable in step S40, then the measurement interval can be increased. Conversely, if the measurement interval is determined to be less stable, or approached one of the threshold values or gets close to a boundary of the safe range, the measurement interval can be decreased. For example, as a default value, the measuring interval can be around 5 minutes, but can be increased to a larger value if for example the measured values from sensors have shown to be stable, or if the battery capacity has been determined to be low, so that additional power savings are needed, to continue operation of the smart container 100 with this method. Also, it is possible that the measurement interval is changed by an intervention from an outside device, for example by a user interface of a central or remote server RS or a mobile device MD that is in communication with the data processing unit ES, for example via satellite data connection, see FIG. 5.

Another step S60 can be performed that is similar to step S10, but having a fast data acquisition rate from sensors 30, to gather substantially more data from sensors 30 for a more detailed observation and storage of the data measured from some or all of the sensors. For example, the data acquisition rate could be increased for a chosen one or more sensors 30, to an interval of 100 ms or lower, when in step S40 has determined that one or more of the measured values from a corresponding sensor 30 lies outside the acceptable range, or lies above or below an acceptable threshold value. If this happens, step S60 can be performed where the specific sensor 40 with the outlying or devious measurement value is accessed and the data stored at a much faster rate, and with step S20 the data is stored or recorded by the data processing unit ES. It is also possible that one measurement from one sensor 30 triggers step S60 for another sensor 30 that will be read out by ES at a substantially increased data acquisition rate. For example, if data processing unit ES determines that a force on one of the side walls 10 from a force measurement sensor has suddenly increased with step S40, it is possible that step S60 will start for the measurements of the absolute orientation sensor to see if the container 100 is in a stable position, to have a much better understanding of the current motion to container 100, to for example whether the increase in force is a result of a shifting of the goods from heavy seas, or impact or collision. Of course, at the same time, the force measurement sensors can also be part of the fast acquisition rate of step S60. As another example, when it is determined that door 20 has been opened with S40, it is possible to rapidly read out the force sensors, weight sensors, or volumetric sensors with step S60 to acquire data on the unloading process with more detail.

Moreover, step S40 can also trigger an additional step S70 of generating an alarm, alert, or signaling that is sent to remote server RS or mobile device MD, and can also be stored in the log data, for example when the seriousness of the situation requires immediate attention, or a notification and data transmission is needed at remote server RS or mobile device MD. For example, this step S70 can be triggered when S40 detects a serious anomaly, for example but not limited to a destructive temperature above a certain second threshold, a location of container 100 by GPS at a place that does not correspond to a position of the current transporting route by the transportation vehicle, an orientation of the container 100 that is not possible under normal transport condition, i.e. the container is not in a horizontal position, detection of fire inside container 100.

During step S40, other correlations and measurements can be done with the measured data by the data processing device 40. For example, the measured temperature inside container 100 can be correlated to the specific goods that are being transported, and compared to a fixed or adaptive temperature threshold, and thereby also calculate the amount of energy required for an external heat source to set the cargo at the desired temperature, and thus infer a time or time frame when the cargo can be unloaded from container 100 if the external heat source has been applied. This information can be sent to remote server RS or mobile device MD for further processing and analysis, and for additional control of container 100 remotely, with step S70.

During step S40, it is possible that the humidity level is analyzed to identify a leakage of container 100, for example when on high seas, but can also be correlated with the measured temperature and measured pressure inside the container 100, to determine if there can be any potential problems of moist and mold build-up, particularly when food goods are transported. The acceleration data, absolute orientation data, or both, can be analyzed with step S40 by data processing device ES to determine whether, based on the goods that are currently transported, there must have been irreparable damage to the goods, or whether they might have been damaged. For example, if goods are transported that are sensitive to accelerations, such as measurement equipment or goods made out of glass or other fragile material, it would be possible to say if the goods will arrive without damage with a high likelihood, and an alert could have been generated by step S70.

Moreover, step S40 can also analyze the wall pressures of side walls 10 and air pressure to check fermentation levels of fermenting goods that are being transported, for example fermenting goods such as wine that are being transported by a flexitank 90 in container 100. Other data that can be analyzed and compared by data processing unit ES by access to sensors 30 can be intrusion detection by door opening sensor, lights sensor, and also with knowledge of the current position of container 100 as well as the historical risk correlated to the pre-defined routes, mitigating thus risk of cargo tampering and illegal trafficking, or at least generating early knowledge that can be sent by an alert with step S70 to remote server RS or other remove device.

Step S70 can also generate information that will allow a conclusion that the cargo or goods of container 100 are lost or irreparably harmed, on a container-by-container basis. For example, a detection of fire combined with a high temperature for a larger period, with a subsequent failure of temperature-sensitive devices, detected by data processing unit ES could be used to send a report or alert that indicates complete loss of the goods, before the goods have actually arrived and are manually inspected at a port or a warehouse. This information, once sent to central server RS, can be used as logistic management information, to inform the receiver or dispatcher, or other person responsible for the logistics, that the goods are lost, and new goods need to be purchased for replacement or timely arrival.

Another step S80 that can be performed by the method of individual container operation and control is a step of data collecting, formatting, and report generating, for example to generate a report RR. This step S80 can be performed solely at data processing device ES, or also performed partially or wholly at remote server RS. The report generating can be performed upon a request that is made and transmitted from a remote server RS or other device, for example mobile device MD, can be generated automatically that is triggered by an event at container 100 itself or by remote control for example mobile device MD, for example but not limited to when step S40 determines that the container 100 has arrived at the port of unloading or discharge by GPS, container 100 has been opened at door 200 as detected by door opening sensors, and the cargo is still inside container by weight, force or volumetric sensor, or can be triggered by an extreme event, for example one that has triggered the alert, alarm, or warning that has also or could have also triggered step S70.

The report generating step S80 can generate a file or a data set DS that can include all the stored and recorded sensor data of the entire measuring period from the start of the measuring of step S05 at data processing device ES, or a partial period thereof, for example determined by pre-stored instructions or instructions received from the outside, for example instructions by server RS. This file or data set DS can be sent to remote server RS for further processing, for example for visualization on graphical user interface, statistical data presentation, data mining, storage, archiving, data analysis and processing. Also, the data stored in data processing device 40 can be analyzed for statistical information and summaries at data processing device or remote server RS, and this data can be presented as a report RR that can be displayed, viewed and used by a user of the system shown in FIG. 5. This report RR can be a quality control report for a given time period or trajectory, for example from the loading until the unloading of the goods that were transported by container 100. The report RR can include an automatically-generated transport quality rating, indicating with a high likelihood if the goods have arrived safe at destination. The report RR can be used to avoid or reduce the amount of warehouse quality control, or other type of quality control, as the report RR provides for information that the container has not experienced any major issue during transport, on a similar approach, a fleet of container reach a same warehouse could prioritize which has to be delivered itself. Generally, the report RR can include data that indicates status, transformation, and other summarizing data of goods and container 100 itself.

Moreover, report RR can be a report that is specialized for customs control at a border. For example, report RR can have a rating or a simple tampered/non-tampered indication for container 100 at a arrival, that can be sent to a customs authority or otherwise made securely available to a customs authority. In this respect, the report RR can indicate if during a given time period or a given trajectory, for example a trajectory that started with the loading of the container 100, the door 20 had been opening, or there was some structural disintegration of the container 100 for example a hole was made to a side wall 10 or other structural element of container 100, for example by monitoring the air pressure that could have allowed for removal, introduction, or other tampering of the goods transported.

The generation of report RR by step S80 can be also triggered by a user or an event. For example, if a cargo ship is affected by a fire, pirate attack, inclement weather, heavy swell, unusual weather temperatures, an operator of remote server RS can make a request to one or more containers 100, for example to all the smart containers 100 of a cargo ship, to send back a report RR to see what the status is, for example whether any of the transported goods are currently being affected by the event, or to see if there what the likelihood is that the goods will be affected by the event, and to allow the logistics manager to take any potential remedial action on a container-by-container basis.

Figure 6:
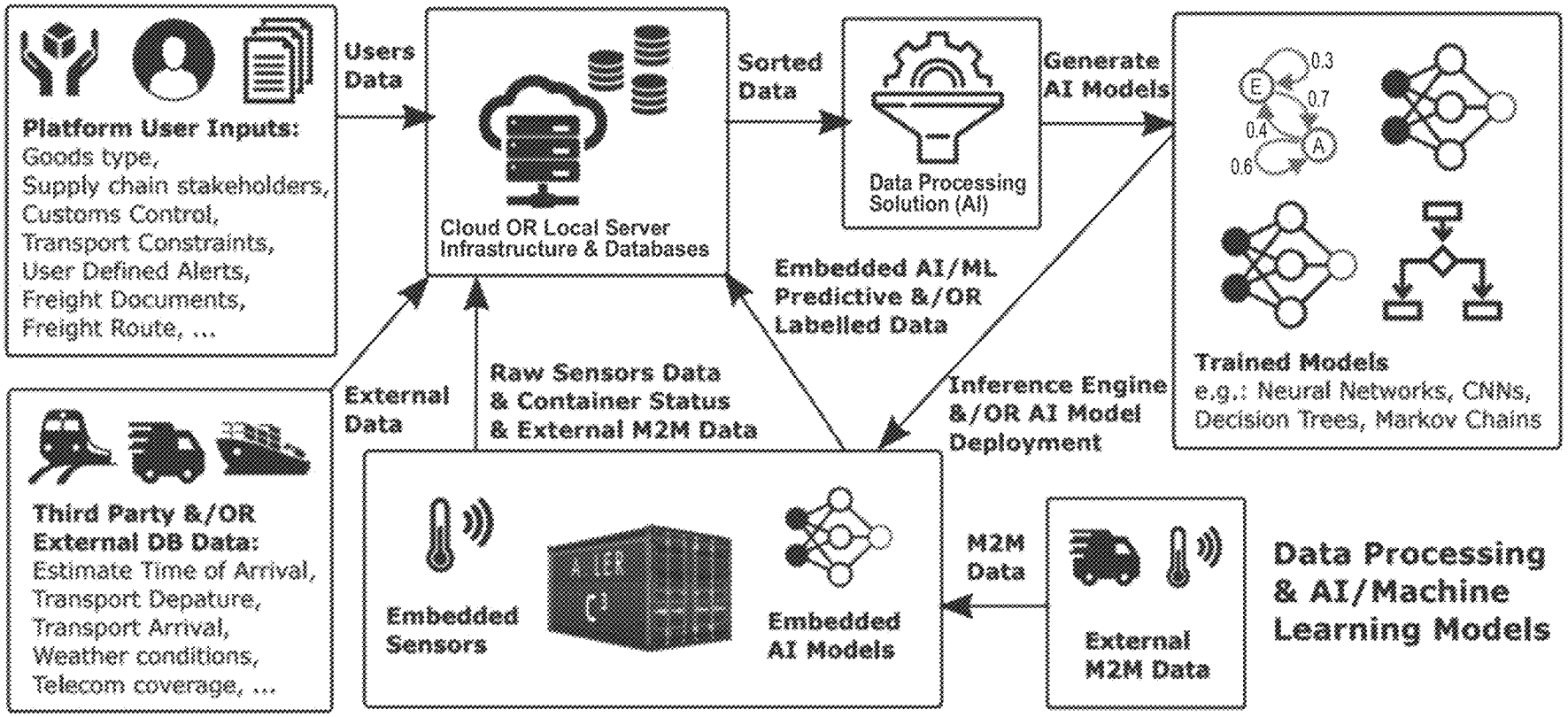
FIG. 6 shows the data-streams used to generate and train machine learning and artificial intelligent models.

As indicated in FIG. 6, trained models such as classifications, regressions, clustering, CNNs, decision trees, Markov chains, neural networks, genetic or swarm intelligence algorithms can be used to analyze the raw or calibrated data from data processing units ES, for example by ES itself or by another remote device, to generate reports such as report RR that summarize or otherwise gather and calculate specific information on the state and quality of the goods that have been transported.

Next, a step S90 can be performed where the report RR or the data set DS is displayed on a computer screen, for example by using a graphical user interface, or is printed out by a printer, for example at a location that is remote or away from the container 100, for example at a terminal that is accessing remote server RS by an operator or user, for example but not limited to a logistics manager, customs officer, quality control manager. Also, a step S95 can be performed where the method is stopped or terminated, so that the data processing unit ES stops accessing data from sensors 30 and recording data. This can be done manually, locally, or by remote control.

Moreover, with this method, it is possible to generate reports to make in-transit inventory of goods that are being transported in smart containers 100. A logistics manager can know in real-time where the cargo is, what is status is, and also the arrival times, which could allow to drastically reduce in-house stock costs at warehouses, thereby using moving cargo by ships, trucks, and freight trains as the moving in-transit warehouses, facilitating just-in-time operations. Depending on the results determined by data from the sensors 30, the ES will be able to determine in which mode of transport the container is, namely train, truck, barge or ship.

Figure 8:
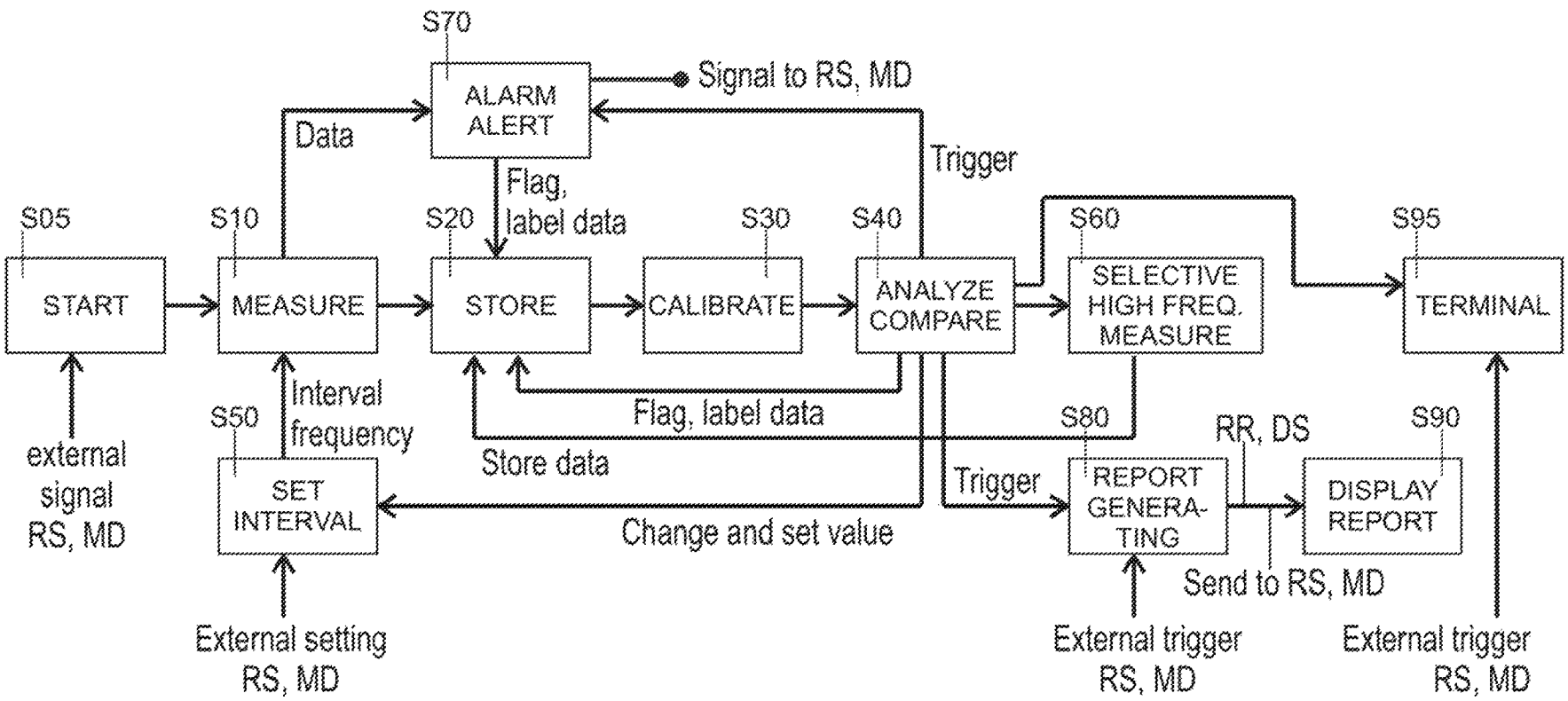
FIG. 8 shows a flowchart of an exemplary method that is performed by the smart container, for example the hybrid container 100.

The indicated order of the performance of the steps as shown in FIG. 8 is merely exemplary, and at least some the steps can also be performed in a different order. For example, the calibrating step S30 can be done before the step of storing S20, the termination step S95 can be done at any time. Also, as an example, the step S60 of high frequency data measuring and gathering can be done in parallel to the step of measuring S10, or can be done in replacement of step S10 for a given period of time. Also, the steps of the method can be performed by a system that includes one or more smart containers 100 each having a data processing unit ES, an communication and network infrastructure with user terminals RS, MD as shown exemplarily in FIGS. 5 and 6.

While the invention has been disclosed with reference to certain preferred embodiments, numerous modifications, alterations, and changes to the described embodiments, and equivalents thereof, are possible without departing from the sphere and scope of the invention. Accordingly, it is intended that the invention not be limited to the described embodiments, and be given the broadest reasonable interpretation in accordance with the language of the appended claims.

The invention claimed is:

1. A shipping container comprising:

a container frame having a rectangular box shape, the container frame including edge posts with horizontal rails and vertical posts;

at least one side wall panel made of a composite structure arranged within a rectangular area formed by four edge posts, the at least one side wall panel including an insulating center frame panel and a bonding flange along the edges of the side wall panel; and an attachment element arranged between the four edge posts of the container frame and the at least one side wall panel, the bonding flange of the at least one side panel attached to the attachment element, wherein the at least one side wall panel further includes a mechanical reinforcement layer that covers at least a part of the bonding flange and the e insulating center frame, the mechanical reinforcement layer tapered towards a center of the insulating center frame.

2. The shipping container of claim 1, wherein an outer surface of an edge post, the attachment element, and the at least one side wall panel are formed to be flat.

3. The shipping container of claim 1, wherein the attachment element includes an L-shaped bracket, an outer surface of one side of the L-shaped bracket adhesively bonded to the edge post, and an inner surface of other side of the L-shaped bracket adhesively bonded to the bonding flange.

4. The shipping container of claim 1, wherein a gap between the attachment element and the edge post is filled with a structural adhesive such that an outer surface of a side of the shipping container formed by the edge posts and the attachment element forms a smooth surface.

5. The shipping container of claim 1, wherein the bonding flange of the side wall panel is smaller in thickness than the insulating center frame, the bonding flange in including a layered composite structure.

6. The shipping container of claim 1, wherein a gap is formed between an outer edge of the bonding flange and a surface of the attachment element facing the outer edge of the bonding flange, the gap filled by a structural adhesive.

7. The shipping container of claim 1, wherein the attachment element includes a metal bonding plate, an inner surface of the metal bonding plate attached to an outer surface of the edge post and an outer surface of the bonding flange.

8. The shipping container of claim 7, wherein the metal bonding plate is welded to the outer surface of the edge post, and is adhesively bonded to the outer surface of the edge post.

9. The shipping container of claim 7, wherein the outer surface of the bonding flange and the outer surface of the edge post are arranged to be flush to each other.

10. The shipping container of claim 7, wherein a gap is formed between an outer edge of the bonding flange and a surface of the edge post facing the bonding flange, the gap filled by a structural adhesive.

11. The shipping container of claim 1, wherein an outer surface of the edge post, the attachment element, and the at least one side wall panel is covered by a closing tape laminate to form a flush outer surface.

12. The shipping container of claim 1, wherein the attachment element includes an L-shaped bracket, wherein the at least one side wall panel is configured to be fitted within the rectangular area formed by two horizontal bars and two vertical posts, via attachment to the L-shaped bracket that is welded to the two horizontal bars and two vertical posts.

13. The shipping container of claim 1, wherein the at least one side wall panel is configured to be fitted within the rectangular area formed by two horizontal bars and two vertical posts, via attachment to a plate-shaped bracket that is welded to the two horizontal bars and two vertical posts.

14. The shipping container of claim 1, wherein the container frame, the at least one side wall panel, and the attachment element are arranged to comply with the ISO 1496-1:2013 test certifications.

15. The shipping container of claim 1, wherein the side wall panels are transparent to x-rays.

16. The shipping container of claim 1, further comprising:

a computer unit having a communication device;

a plurality of sensors measuring environmental parameters of the shipping container arranged at the side wall panels, the plurality of sensors operatively connected to the computer unit by the communication device; and a wireless communication interface operatively connected to the computer unit.

17. The shipping container of claim 16, wherein the computer unit is integrated into at least one of the side panels or in a door panel.

18. The shipping container of claim 16, wherein the plurality of sensors include a humidity sensor that is configured to measure a humidity inside the container, and a temperature sensor that is configured to measure a temperature inside the container.

19. The shipping container of claim 16, wherein the computer unit is configured to gather data from the plurality of sensors of values measured inside the container during a measurement period, detect a trigger signal from an abnormal condition based on the data of the plurality of sensors, and generate a report that is sent to an external server, the report including data on the integrity of transported goods of the shipping container.

20. The shipping container of claim 19, wherein the report includes an inventory of the transported goods.

* * * * *